US011407965B2

(12) United States Patent
Chen et al.

(10) Patent No.: US 11,407,965 B2
(45) Date of Patent: Aug. 9, 2022

(54) DETERGENT ADDITIVE

(71) Applicant: Dow Global Technologies LLC, Midland, MI (US)

(72) Inventors: Xue Chen, Manvel, TX (US); Xin Jin, Berwyn, PA (US); Liang Chen, Sewickley, PA (US)

(73) Assignee: DOW GLOBAL TECHNOLOGIES LLC, Midland, MI (US)

( * ) Notice: Subject to any disclaimer, the term of this patent is extended or adjusted under 35 U.S.C. 154(b) by 104 days.

(21) Appl. No.: 16/632,902

(22) PCT Filed: Jul. 10, 2018

(86) PCT No.: PCT/US2018/041364

§ 371 (c)(1),
(2) Date: Jan. 22, 2020

(87) PCT Pub. No.: WO2019/027629

PCT Pub. Date: Feb. 7, 2019

(65) Prior Publication Data

US 2020/0165545 A1 May 28, 2020

Related U.S. Application Data

(60) Provisional application No. 62/539,180, filed on Jul. 31, 2017.

(51) Int. Cl.

| | |
|---|---|
| ***C11D 3/39*** | (2006.01) |
| ***C11D 11/02*** | (2006.01) |
| ***C11D 3/37*** | (2006.01) |

(52) U.S. Cl.
CPC ..... *C11D 3/3917* (2013.01); *C11D 3/3757* (2013.01); *C11D 11/02* (2013.01)

(58) Field of Classification Search
CPC ..... C11D 3/3917; C11D 3/3757; C11D 11/02
See application file for complete search history.

(56) References Cited

U.S. PATENT DOCUMENTS

| | | | | |
|---|---|---|---|---|
| 5,858,959 | A * | 1/1999 | Surutzidis | C11D 3/505 510/315 |
| 5,965,505 | A | 10/1999 | Baillely et al. | |
| 6,080,710 | A * | 6/2000 | Withenshaw | C11D 3/3917 252/186.25 |
| 6,448,212 | B1 * | 9/2002 | Holderbaum | C11D 17/042 510/276 |
| 8,193,142 | B2 | 6/2012 | Lalgudi et al. | |
| 8,262,804 | B2 | 9/2012 | Weber et al. | |
| 2002/0160930 | A1 * | 10/2002 | Emmerson | C11D 3/378 510/447 |
| 2004/0072716 | A1 * | 4/2004 | Kistenmacher | C11D 3/3932 510/475 |
| 2004/0102346 | A1 * | 5/2004 | Carr | C11D 1/143 510/276 |
| 2006/0263402 | A1 * | 11/2006 | Deckner | B01J 13/02 424/401 |
| 2008/0044445 | A1 | 2/2008 | Rubin | |
| 2009/0156454 | A1 * | 6/2009 | Schmiedel | C11D 3/38672 510/302 |
| 2010/0227788 | A1 | 9/2010 | Schmiedel et al. | |
| 2010/0234262 | A1 * | 9/2010 | Smith | C11D 11/0023 510/161 |
| 2010/0234265 | A1 * | 9/2010 | Weber | C11D 1/72 510/230 |
| 2012/0302487 | A1 | 11/2012 | Armstrong | |
| 2013/0116161 | A1 * | 5/2013 | Di Bono | C11D 3/3907 510/418 |
| 2018/0251710 | A1 * | 9/2018 | Pijnenburg | C11D 3/36 |
| 2020/0148810 | A1 * | 5/2020 | Zhao | C08G 18/0866 |
| 2020/0148976 | A1 * | 5/2020 | Chen | C11D 11/02 |
| 2020/0165545 | A1 * | 5/2020 | Chen | C11D 7/3263 |

FOREIGN PATENT DOCUMENTS

| | | | | |
|---|---|---|---|---|
| CA | 2233622 | | 4/1997 | |
| CA | 2233622 | A1 * | 4/1997 | C11D 3/3935 |
| CN | 1094514 | C | 11/2002 | |
| CN | 101821370 | A | 9/2010 | |
| EP | 0468824 | | 1/1992 | |
| EP | 0510762 | A2 * | 10/1992 | C11D 3/3773 |
| EP | 0510762 | A2 | 10/1992 | |
| EP | 2007863 | B1 | 12/2008 | |
| WO | 2014064252 | A2 | 5/2014 | |
| WO | 2015091877 | | 6/2015 | |
| WO | 2017040501 | | 3/2017 | |

OTHER PUBLICATIONS

ISOBAM Catalog. (Year: 2014).*
PCT/US2018/041364, Search Report and Written Opinion dated Sep. 27, 2018.
PCT/US2018/041364, International Preliminary Report on Patentability dated Feb. 4, 2020.
Duo-Ren, Production and Application of Modern Polymer Materials, China Petrochemical Press, May 2002, p. 194.
Zheng, Analysis Methods and Application of Polymer Materials, Shanghai Science and Technology Press, Jan. 2009, p. 267.

* cited by examiner

*Primary Examiner* — Liam J Heincer
*Assistant Examiner* — M. Reza Asdjodi

(57) ABSTRACT

A detergent additive comprising an active, the active comprising one or both of tetraacetylethylenediamine or triacetylethylenediamine; and a copolymer having maleic anhydride-based repeat units and either or both of olefinic or styrenic-based repeat units; and wherein at least a portion of the maleic anhydride-based repeat units are neutralized.

7 Claims, No Drawings

DETERGENT ADDITIVE

BACKGROUND

Textiles, such as wearable fabrics, are typically washed by contacting the textiles with a detergent formulation that is a combination of detergent components and other optional actives, such as bleaching agents. For ease of use, many detergent formulation users prefer an all-in-one product that incorporates the detergents and optional actives into a single product. Further, many users prefer this product to be a liquid, as compared to a solid or granular product.

One common detergent active is tetraacetylethylenediamine (TAED). TAED functions as a peroxy bleaching activator and a microbial control agent. TAED has been extensively used in solid detergent products. TAED, in liquid detergent formulations which contain in part water, will undergo hydrolysis and lose effectiveness as a detergent active as the TAED reacts to form N,N'diacetylethylenediamine (DAED), which is not effective as a detergent active. As such, TAED, when used without modification, is not ideal as an active for an aqueous detergent formulation. Triacetylethylenediamine (TriAED) is another detergent active. A detergent additive containing one or both of TAED or TriAED that is suitable for use in a liquid detergent formulations that contain water is desired.

SUMMARY OF THE INVENTION

A detergent additive comprising an active, the active comprising one or both of tetraacetylethylenediamine or triacetylethylenediamine; a copolymer having maleic anhydride-based repeat units and either or both of olefinic or styrenic-based repeat units; and wherein at least a portion of the maleic anhydride-based repeat units are neutralized.

DETAILED DESCRIPTION OF THE INVENTION

The present disclosure describes an improved detergent additive. In one aspect, the present disclosure describes a detergent additive comprising an active, for example, tetraacetylethylenediamine (TAED), and a copolymer having maleic anhydride-based repeat units and either or both of olefinic or styrenic-based repeat units wherein at least a portion of the maleic anhydride-based repeat units are neutralized. The improvement of the detergent additive described herein is increased hydrolytic stability for TAED which gives enhanced long-term stability in an aqueous detergent formulation.

A variety of linear and branched chain alpha-olefins are suitable for use as the olefinic-based repeat units of the copolymer. Particularly useful alpha-olefins are 1-alkenes containing 4 to 12 carbon atoms, preferably 3 to 10 carbon atoms, such as isobutylene, 1-butene, 1-hexene, 1-octene, 1-decene and 1-dodecene, with isobutylene and 1-octene being preferred. A part of the alpha-olefins can be replaced by other monomers, with isobutylene being most preferred.

Copolymers of maleic anhydride and styrene are commercially available and suitable for use in the methods and compositions of the present disclosure. For example, maleic anhydride styrene copolymers from Lubrizol company.

Copolymers of maleic anhydride and olefin are commercially available and suitable for use in the methods and compositions of the present disclosure. For example, ISOBAM brand maleic anhydride copolymers are available from Kuraray Co. (Japan) or ACUSOL™ 460ND available from The Dow Chemical Company The weight average molecular weight of the copolymer is preferably 1,000 to 10,000,000. The weight average molecular weight of the copolymer is more preferably 50,000 to 500,000. Preferably, the maleic anhydride-based repeat units comprise from 40 to 60 mole % of the copolymer, more preferably from 45 to 55 mole %, and more preferably from 48 to 52 mole %.

At least a portion of the maleic anhydride-based repeat units of the copolymer are neutralized. Neutralization is measured as a mole percent of acid functionalities of the maleic anhydride-based repeat units which have been neutralized. Preferably 30 to 60 mole percent of the acid functionalities of the maleic anhydride-based repeat units of the copolymer are neutralized.

The maleic anhydride-based repeat units are neutralized with a neutralization agent. Preferably, the neutralization agent is sodium hydroxide, potassium hydroxide, ammonium hydroxide, monoethanolamine, diethanolamine, triethanolamine, aminomethyl propanol, other monoamines, multifunctional amines, or a combination thereof.

The copolymer is neutralized as is known. In one instance, the copolymer is neutralized by agitating the copolymer in a heated aqueous solution containing the copolymer and the neutralization agent, thereby providing a copolymer dispersion. The copolymer dispersion comprises water and the reaction product of the neutralization agent and the copolymer.

The detergent additive is prepared by adding the TAED powder to the copolymer dispersion with heat and agitation, and then drying and isolating the additive. In one instance, the detergent additive is prepared by adding the TAED powder to the copolymer dispersion with agitation and then spray drying with heat. In one instance, the detergent additive is prepared by adding the TAED powder to the copolymer dispersion with agitation, and then by adding an acid solution and then drying and isolating the additive. Wherein the acid solution can be HCl, $H_2SO_4$, an organic acid or inorganic acid solution. The addition of the acid solution preferably brings the pH of the dispersion to less than 7. Preferably, the addition of the acid solution brings the pH of the dispersion to less than 5.

The detergent additive is 90 weight percent or less TAED and 10 weight percent or more copolymer. In one instance, the detergent additive is 75 weight percent or less TAED and 25 weight percent or more copolymer. Preferably, the detergent additive is 50 weight percent or less TAED and 50 weight percent or more copolymer.

One or more compounds are optionally included as part of the detergent additive. Compounds which decrease the water solubility of the detergent additive are preferred. In one instance, compounds are multi-valent metal salt hydrates. Multi-valent metal salt hydrates including combinations of chloride, nitrate, sulfate, and acetate of $Fe^{3+}$, $Al^{3+}$, $Ca^{2+}$, $Zn^{2+}$, $Mn^{2+}$ and metal (hydr)oxide precursors which can react with carboxylic acids such as ZnO, $Ca(OH)_2$ are suitable. As used herein "(hydr)oxide" means either hydroxide or oxide.

The solid detergent additive can be optionally separated from the liquid and dried to generate an additive granule. The additive granules can be optionally grounded or milled into powder form to afford solid active ingredients which have a controlled or delayed releasing profile.

As described herein, the additive encapsulates, or partially encapsulates, the active. As used herein, "encapsulated" refers to the active being bound or retained within the copolymer network. The additives described herein are designed to release the active during a triggering event (in the context of the present disclosure, the triggering event might be use in a washing machine). When referring to the active being encapsulated, it refers to the active being retained within the copolymer network prior to the triggering event. The additives prepared according to the methods of the present disclosure have an encapsulating efficiency of 30 to 100 percent. Preferably, the additives prepared according to the methods of the present disclosure have an encapsulating efficiency of 60 to 100 percent. More preferably, the additives prepared according to the methods of the present disclosure have an encapsulating efficiency of 90 to 100 percent. As used herein, "encapsulating efficiency" refers to the percentage of prospective actives that are encapsulated in the copolymer network of the additive.

The detergent additive described herein has a better long-term stability in aqueous systems than TAED alone. When the detergent additive is used in a washing machine the TAED is released from the copolymer, allowing the TAED to be available in the washing system to perform its peroxy bleach activating function.

The methods described herein are suitable for preparing other types of solid powder systems. For example, the methods described herein can include but are not limited to encapsulating fabric softening agents, detergent actives, bleach actives, fertilizers, micronutrients, pesticides (fungicides, bactericides, insecticides, acaricides, nematocides, and the like), biocides, microbial control agents, polymeric lubricants, fire retardants, pigments, dyes, urea inhibitors, food additives, flavorings, pharmaceutical agents, tissues, antioxidants, cosmetic ingredients (fragrances, perfumes and the like), soil amendments (soil repelling agents, soil release agents and the like), catalysts, diagnostic agents and photoprotective agents (UV blockers and the like).

EXAMPLES

Materials and Encapsulated Examples

Example 1

TAED solid was purchased from Sigma Aldrich and was then milled using an 80 m sieve to generate fine powders. A copolymer of poly(maleic anhydride-alt-isobutylene) with a weight average molecular weight of 160,000 (marketed as ISOBAM-10 by Kuraray) was used.

The copolymer dispersion with 30% neutralization level is prepared as follows. 600 g of deionized (DI) water and 31.13 g of 50 wt % NaOH aqueous solution were added to a 1000 ml glass jar. After mixing for 2 minutes, 100 g of the copolymer powder was added to the jar. The mixture was then heated by a hot plate at 120° C. with agitation. The mixture became a milky and white dispersion after 3 days.

61.8 grams of copolymer dispersion was added to a plastic jar and stirred with an overhead mixer at 500 rpm. 8.1 grams of TAED powder was added slowly to the dispersion. After 10 minutes of agitation, the mixture became a viscous white suspension. The material was then transferred to an aluminum pan with a stir bar. The pan was placed on a hot plate at 110° C., while the agitation continued for 90 minutes. The blend became more viscous. The content was further dried in a vacuum oven at 40° C. for 16 hours. The obtained material is a white foam-like solid composite. It was ground into a fine powder with a mortar and pestle.

Example 2

TAED solid was purchased from Sigma Aldrich and milled using an 80 am sieve to generate fine powders. A copolymer of poly(maleic anhydride-alt-isobutylene) with a weight average molecular weight of 160,000 (marketed as ISOBAM-10 by Kuraray) was used.

The copolymer dispersion at a 50% neutralization level is prepared as follows. 600 g of deionized (DI) water and 51.9 g of 50 wt % NaOH aqueous solution were added to a 1000 ml glass jar. After mixing for 2 minutes, 100 g of the copolymer powder was added to the jar. The mixture was then heated by a hot plate at 120° C. with agitation. The mixture became a milky and white dispersion after 3 days.

32.4 grams of the copolymer dispersion and 10 grams of TAED powder were weighed in a 250 ml 3-neck flask with a stir plate and a glass stopper. 9.5 g of 10% HCl aqueous solution were added into a 100 ml addition funnel that was connected to the flask. The stirrer was connected to a high speed overhead stirrer and the mixer was turned on slowly. After increasing the speed to 1000 rpm, a 10% HCl aqueous solution was added to the flask drop-wise, which generated a white precipitate. The precipitates were isolated by filtration and washed by DI water a few times and dried in air at room temperature.

Example 3

The copolymer dispersion is prepared as follows. 400 grams of DI water and 100 grams of poly(maleic anhydride-alt-isobutylene) copolymer (sold under the trade name ACUSOL™ 460ND by The Dow Chemical Company, nearly 100% neutralized) were added to a 1000 ml glass jar. The mixture was agitated by a stir bar for an hour at room temperature. The mixture then became a clear solution with 10 wt % copolymer concentration.

8.0 grams of TAED powder and 56.1 grams of the copolymer dispersion were weighed in a 250 ml 3-neck flask. A mechanical stirring rod and a glass stopper were attached to the flask. 34.0 grams of 10% HCl aqueous solution was weighed in a 100 ml addition funnel and the funnel was connected to the flask. The agitation speed of a mechanical stirrer was set to 1000 rpm and the 10% HCl aqueous solution was added to the flask drop-wise. After all HCl aqueous solution was added, the mixture was stirred for 10 minutes. The solid was isolated from the mixture by filtration. The collected solid product was washed by DI water three times. The product was dried at room temperature overnight. The final product is a white powder.

Example 4

The copolymer dispersion with 50% neutralization level is prepared as follows. 400 grams of DI water and 100 grams of poly(maleic anhydride-alt-isobutylene) copolymer (sold under the trade name ACUSOL 460ND by The Dow Chemical Company, nearly 100% neutralized) were added to a 1000 ml glass jar. The mixture was agitated by a stir bar for an hour at room temperature. The mixture then became a clear solution with 10 wt % copolymer concentration.

8.0 grams of TAED powder and 56.1 grams of the copolymer dispersion were weighed in a 250 ml 3-neck flask. A mechanical stirring rod and a glass stopper were attached to the flask. 35.9 grams of 10% HCl aqueous solution was weighed in a 100 ml addition funnel and the funnel was connected to the flask. The agitation speed of a mechanical stirrer was set to 1000 rpm and the 10% HCl aqueous solution was added to the flask drop-wise. After all aqueous HCl solution was added, the mixture was stirred for 10 minutes. The solid was isolated from the mixture by filtration. The collected solid product was washed by DI water three times. The product was dried at room temperature overnight. The final product is a white powder.

Example 5

The copolymer dispersion with 50% neutralization level is prepared as follows. 497.2 g of DI water and 103.6 g of 50 wt % NaOH aqueous solution were added to a 1000 ml glass jar. After 2 minutes of mixing, a copolymer of poly (maleic anhydride-alt-isobutylene) with a weight average molecular weight of 160,000 (marketed as ISOBAM-10 by Kuraray, 100 g) was added to the jar. The mixture was heated by a hot plate at 100° C. with agitation. The mixture with 14.27 wt % solid concentration and 100% neutralization level of ISOBAM-10 became a clear solution after one day.

10.0 grams of TAED powder and 35.0 grams of the copolymer dispersion were weighed in a 250 ml 3-neck flask. A mechanical stirring rod and a glass stopper were attached to the flask. 18.9 grams of 10% HCl aqueous solution was weighed in a 100 ml addition funnel and the funnel was connected to the flask. The agitation speed of a mechanical stirrer was set to 1000 rpm and the 10% HCl aqueous solution was added to the flask drop-wise. After all HCl aqueous solution was added, the mixture was stirred for 10 minutes. The solid was isolated from the mixture by filtration. The collected solid product was washed by DI water three times. The product was dried at room temperature overnight. The final product is a white powder.

Example 6

The copolymer dispersion with 50% neutralization level is prepared as follows. 497.2 g of DI water and 103.6 g of 50 wt % NaOH aqueous solution were added to a 1000 ml glass jar. After 2 minutes of mixing, a copolymer of poly (maleic anhydride-alt-isobutylene) with a weight average molecular weight of 160,000 (marketed as ISOBAM-10 by Kuraray, 100 g) was added to the jar. The mixture was heated by a hot plate at 100° C. with agitation. The mixture with 14.27 wt % solid concentration and 100% neutralization level of ISOBAM-10 became a clear solution after one day.

10.0 grams of TAED powder and 35.0 grams of the copolymer dispersion were weighed in a 250 ml 3-neck flask. A mechanical stir plate and a glass stopper were attached to the flask. 16.6 grams of 10% HCl aqueous solution was weighed in a 100 ml addition funnel and the funnel was connected to the flask. The agitation speed of a mechanical stirrer was set to 1000 rpm and the 10% HCl aqueous solution was added to the flask drop-wise. After all HCl aqueous solution was added, the mixture was stirred for 10 minutes. The solid was isolated from the mixture by filtration. The collected solid product was washed by DI water three times. The product was dried at room temperature overnight. The final product is a white powder.

Example 7

The copolymer dispersion with 50% neutralization level is prepared as follows. 497.2 g of DI water and 103.6 g of 50 wt % NaOH aqueous solution were added to a 1000 ml glass jar. After 2 minutes of mixing, a copolymer of poly (maleic anhydride-alt-isobutylene) with a weight average molecular weight of 160,000 (marketed as ISOBAM-10 by Kuraray, 100 g) was added to the jar. The mixture was heated by a hot plate at 100° C. with agitation. The mixture with 14.27 wt % solid concentration became a clear solution after one day.

10.0 grams of TAED powder and 70.1 grams of the copolymer dispersion were weighed in a 250 ml 3-neck flask. A mechanical stirring rod and a glass stopper were attached to the flask. 33.1 grams of 10% HCl aqueous solution was weighed in a 100 ml addition funnel and the funnel was connected to the flask. The agitation speed of a mechanical stirrer was set to 1000 rpm and the 10% HCl aqueous solution was added to the flask drop-wise. After all HCl aqueous solution was added, the mixture was stirred for 10 minutes. The solid was isolated from the mixture by filtration. The collected solid product was washed by DI water three times. The product was dried at room temperature overnight. The final product is a white powder.

Example 8

5.0 g of jet milled TAED powder (1-2 micron) was mixed with 50 g of a copolymer of poly(maleic anhydride-alt-isobutylene) with a weight average molecular weight of 160,000 (marketed as ISOBAM-10 by Kuraray) solution (10 wt % solid), and 45 g of DI water and 1.0 g of aqueous dispersion zinc oxide nanoparticles (Aldrich, <100 nm, 50 wt % solids) using an overhead mixer to form a homogeneous dispersion. The solid content of the mixture was approximately 10 wt %. The mixture was then spray dried using a spray dryer (manufactured by Mobile Minor, liquid feed rate setting=15-20 mL/min, atomization N2=1 bar 40%, inlet temperature was set at 120° C. and the outlet temperature was equilibrated at 45-50° C.). A targeted encapsulated TAED formulation is copolymer:TAED:ZnO=5:5:0.5.

Example 9

5 g of TAED powder (jet milled to 1-2 micron) was mixed with 50 g of a copolymer of poly(maleic anhydride-alt-isobutylene) with a weight average molecular weight of 160,000 (marketed as ISOBAM-10 by Kuraray) solution (50% of MAH groups neutralized with NaOH, 10 wt % solids) and DI water using an overhead mixer to form a homogeneous dispersion. The solid content of the mixture was approximately 10 wt %. The mixture was then spray dried using a spray dryer (manufactured by Mobile Minor, liquid feed rate setting=15-20 mL/min, atomization $N_2$=1 bar 40%, inlet temperature was set at 120° C. and the outlet temperature was equilibrated at 45-50° C.). The targeted formulation of the encapsulation TAED is copolymer:TAED=1:1.

Example 10

5.5 g of Jet milled TAED powder (1-2 micron) was mixed with a copolymer of poly(maleic anhydride-alt-isobutylene) with a weight average molecular weight of 160,000 (marketed as ISOBAM-10 by Kuraray, 50 g) solution (10 wt % solid), and an aqueous solution of calcium acetate (0.5 g calcium acetate in 45 g of DI water) using an overhead mixer to form a homogeneous dispersion. The solid content of the mixture was approximately 10 wt %. The mixture was then spray dried using a spray dryer (manufactured by Mobile Minor, liquid feed rate by peristaltic pump (setting=17.5 mL/min), atomization nitrogen flow rate is 25% at 1 bar (~3 kg/hour), inlet temperature was set at 120° C. and the outlet temperature was equilibrated at 48° C.). The targeted formulation is: copolymer:calcium acetate:TAED=5:0.5:5.5.

Example 11

4.8 g of Jet milled TAED powder (1-2 micron) was mixed with a copolymer of poly(maleic anhydride-alt-isobutylene)

with a weight average molecular weight of 160,000 (marketed as ISOBAM-10 by Kuraray, 50 g) solution (10 wt % solid) and 45 g of deionized water using an overhead mixer to form a homogeneous dispersion. 8 g of $AlCl_3$ aqueous solution (5 wt % solid) was slowly added into the mixture while stirring the mixture. The solid content of the mixture was approximately 10 wt %. The mixture was then spray dried using a spray dryer (manufactured by Mobile Minor, liquid feed rate by peristaltic pump (setting=12.5 mL/min), atomization nitrogen flow rate is 40% at 1 bar (~5 kg/hour), inlet temperature was set at 120° C. and the outlet temperature was equilibrated at 50° C.). The targeted formulation is copolymer:TAED:$AlCl_3$=5:4.8:0.2.

Comparative Example 1

In this example the copolymer is not neutralized. 600 g of DI water and a copolymer of poly(maleic anhydride-alt-isobutylene) with a weight average molecular weight of 160,000 (marketed as ISOBAM-10 by Kuraray, 100 g) powder was added to a 1000 ml glass jar. The mixture was heated by a hot plate at 120° C. with agitation. There is no sign of polymer dissolving in the aqueous phase.

Comparative Example 2

5.0 g of jet milled TAED powder (1-2 micron) was mixed with 100 g of ACUSOL 445 solution (10 wt % solid), and 45 g of DI water using an overhead mixer to form a homogeneous dispersion. The solid content of the mixture was approximately 15 wt %. The mixture was then spray dried using a Mobile Minor spray dryer under the conditions: liquid feed rate setting=12.5 mL/min, atomization N2=1 bar 40%. The inlet temperature was set at 120° C. and the outlet temperature was equilibrated at 45° C. A targeted encapsulated TAED formulation is ACUSOL:TAED=2:1. Acusol 445 from The Dow Chemical Company is a polyacrylic acid partially neutralized Na form with MW of 4.5 kg/mol.

Encapsulation Performance Evaluation

Bleaching (Oxidation) of Blue Color Food Dye 5 droplets of an aqueous blue colored food dye (FD&C blue #1, a triarylmethane dye) was added to 500 ml water followed and mixed for 1 hour to generate a homogenous dye/water solution. 1 gram of the dye/water solution, 1 gram $H_2O_2$ 30% water solution purchased from Sigma-Aldrich, and targeted amounts of TAED were added into a vial and followed by mixing for 5 min. the detailed formulation of each vial is in the table below.

The loss of blue color which is indicative of bleaching (oxidation) performance was evaluated after 12 hours and compared to the control samples.

TABLE 1

Sample formulation of Food Blue Color Dye Evaluation Method

| Vial | Dye water solution (g) | 30% $H_2O_2$ (g) | TAED powder (g) | TAED examples | Observation after 12 hours |
|---|---|---|---|---|---|
| Control 1 | 1 | 1 | 0 | No TAED | No change |
| Control 2 | 1 | 1 | 0.02 | TAED without encapsualtion | Color Fade |
| 1 | 1 | 1 | 0.04 | Example 8 | Similar color |
| 2 | 1 | 1 | 0.04 | Example 9 | Similar color |
| 3 | 1 | 1 | 0.04 | Example 3 | Similar color |

TABLE 1-continued

Sample formulation of Food Blue Color Dye Evaluation Method

| Vial | Dye water solution (g) | 30% $H_2O_2$ (g) | TAED powder (g) | TAED examples | Observation after 12 hours |
|---|---|---|---|---|---|
| 4 | 1 | 1 | 0.04 | Example 4 | Similar color |
| 5 | 1 | 1 | 0.067 | Comparative Example 2 | Color fade |

As shown in Table 1, after standing at room temperature overnight (12 hours), the control sample (Control 2) with un-encapsulated TAED, has bleached the blue color (color faded), while other samples that contain encapsulated TAED (vials 1 to 4) still have the same blue color, indicating good encapsulation efficiency. In comparative example 2, which contains TAED encapsulated with a partially neutralized acrylic polymer, the blue color also faded.

HPLC Analysis for Determining Hydrolysis of TAED to DAED 0.5 g of TAED without encapsulation and encapsulated TAED powders selected from the Examples listed in the Table below were each individually added to a vial containing 20 g All™ Mighty Pac™ detergent, and shaken for 10 min. 1 droplet (ca. 0.1 g) of the mixture from each vial was added individually to separate vials containing 10 g 1:3 Acetonitrile/$H_2O$ solvent, and sonicated for 15 minutes to fully dissolve the solid TAED. The concentration of N,N'di-acetylethylenediamine (DAED) of the prepared samples were measured using an Agilent 1100 High-Performance Liquid Chromatography (HPLC) with quaternary pump and diode array detector. The HPLC method conditions are summarized in the table below.

TABLE 2

HPLC Testing Conditions

| | | | |
|---|---|---|---|
| System | Agilent 1100 with quaternary pump and diode array detector | | |
| Column | Eclipse XDB-C18: 4.6 mm × 50 mm × 5 μm | | |
| Column Temperature | 40° C. | | |
| Injection Volume | 1 μL sample | | |
| Flow Rate | 1 mL/min | | |
| Mobile Phases | A = 18.2 MΩ-cm water, B = acetonitrile | | |
| | Time | Composition | |
| Gradient | (min) | % A | % B |
| | 0.0 | 65 | 35 |
| | 3.5 | 0 | 100 |
| | 5.5 | 0 | 100 |
| Equilibration Time | 2.5 min | | |
| Total Run Time | ~10 | | |
| Detection | UV (DAD) @ 216 nm, BW 4 nm, 1 cm cell (TAED)<br>UV (DAD) @ 205 nm, BW 4 nm, 1 cm cell (DAED) | | |

TABLE 3

HPLC evaluation results on DAED concentration

| | Initial day | Day 1 | Day 2 | Day 7 | Day 20 | Day 36 |
|---|---|---|---|---|---|---|
| TAED without encapsulation | 0 | 0.036 | 0.116 | 0.284 | 0.593 | 0.760 |
| Example 1 | 0 | 0.048 | 0.082 | 0.177 | 0.249 | 0.291 |
| Example 4 | 0 | 0.076 | 0.102 | 0.199 | 0.406 | 0.515 |
| Example 5 | 0 | 0.052 | 0.106 | 0.248 | 0.422 | 0.600 |

TABLE 3-continued

| HPLC evaluation results on DAED concentration | | | | | | |
|---|---|---|---|---|---|---|
| | Initial day | Day 1 | Day 2 | Day 7 | Day 20 | Day 36 |
| Example 6 | 0 | 0.039 | 0.090 | 0.228 | 0.378 | 0.599 |
| Example 7 | 0 | 0.039 | 0.088 | 0.228 | 0.404 | 0.613 |
| Example 8 | 0 | 0.046 | 0.106 | 0.251 | 0.477 | 0.528 |
| Example 9 | 0 | 0.057 | 0.114 | 0.281 | 0.485 | 0.481 |
| Example 10 | 0 | 0.000 | 0.075 | 0.218 | 0.499 | 0.612 |
| Example 11 | 0 | 0.000 | 0.077 | 0.202 | 0.379 | 0.440 |

As shown in the Table above, for TAED without any encapsulation, the DAED concentration increases significantly with time, for the other examples which contain encapsulated TAED, the DAED increased at a comparatively slower rate. Since DAED is generated from TAED hydrolysis, the slower increase in DAED concentration indicates good encapsulation efficiency.

The invention claimed is:

1. A detergent additive comprising:

an active, the active comprising one or both of tetraacetylethylenediamine or triacetylethylenediamine; and a copolymer having maleic anhydride-based repeat units and either or both of olefinic or styrenic-based repeat units; and wherein at least a portion of the maleic anhydride-based repeat units are neutralized, wherein the active is retained within the copolymer network prior to a triggering event, and wherein the additive comprises 25 weight percent or less of the active and 75 weight percent or more of the copolymer.

2. The detergent additive of claim 1, wherein the copolymer is an alternating copolymer, a random copolymer or a block copolymer.

3. The detergent additive of claim 1, wherein the olefinic or styrenic-based repeat units are derived from ethylene, propylene, isobutene, octadodecene, styrene or a mixture thereof.

4. The detergent additive of claim 1, wherein the copolymer has a weight average molecular weight of from 50,000 to 500,000.

5. The detergent additive of claim 1, wherein 30 to 60 mole percent of acid functionalities of the maleic anhydride-based repeat units are neutralized.

6. The detergent additive of claim 1, wherein the maleic anhydride-based repeat units are neutralized with a neutralization agent selected from the list consisting of sodium hydroxide, potassium hydroxide, ammonium hydroxide, monoethanolamine, diethanolamine, triethanolamine, aminomethyl propanol, other monoamines, multifunctional amines, or a combination thereof.

7. The detergent additive of claim 1, wherein the encapsulating efficiency of the active in the detergent additive is from 60 to 100 percent.

* * * * *